United States Patent [19]

Pool et al.

[11] 3,950,214

[45] Apr. 13, 1976

[54] HAND MASKING MACHINE

[76] Inventors: Danny L. Pool, 2045 E. Broadway No. 26, Tempe, Ariz. 85281; Robert R. Pool, 607 E. Franklin, Mesa, Ariz. 85204

[22] Filed: Nov. 18, 1974

[21] Appl. No.: 524,629

[52] U.S. Cl. ..... 156/527; 156/554; 156/577

[51] Int. Cl.[2] ..... B32B 31/00

[58] Field of Search ..... 156/527, 554, 577, 579

[56] References Cited

UNITED STATES PATENTS

| | | | |
|---|---|---|---|
| 2,522,773 | 9/1950 | Bihary | 156/554 |
| 2,916,078 | 12/1959 | Hebert | 156/554 |
| 3,120,461 | 2/1964 | Harbour | 156/554 |
| 3,463,694 | 8/1969 | De Roshia | 156/577 |
| 3,600,255 | 8/1971 | Hinds | 156/577 |

*Primary Examiner*—Douglas J. Drummond

[57] ABSTRACT

A manually operable masking machine having a frame adapted to support a roll of masking paper and a tape dispensing roller so that paper and tape may be dispensed such that the tape overlaps the edge of the paper and extends there beyond the edge of the paper to adhesively be engaged with a surface for holding the paper in juxtaposition on the surface. The machine having a roll of paper and a roll of tape which are substantially equal in length and being provided with a cut off blade adjacent to an applicator roller which receives paper and tape at its periphery in adjacent relationship with an idler roller which passes the tape and the paper together immediately before dispensation around the applicator roller which presses the paper and tape onto a surface being masked. The machine also having a novel key means for insuring the fitting only of proper paper to the spindle of the machine to insure quality control of the paper being used such that the paper will have a uniform thickness adapted to coincide with the spacing between the idler roller and the applicator roller to insure proper adhesion of the tape with the paper and proper application of the paper and tape to a surface which is being masked. The machine also having a novel disposition of the handle such as to allow convenient application of tape and paper to a surface while at the same time supporting a roll of paper and a roll of tape conveniently adjacent to surface without interfering with the use of applicator roller for applying the tape and paper to such surface.

5 Claims, 6 Drawing Figures

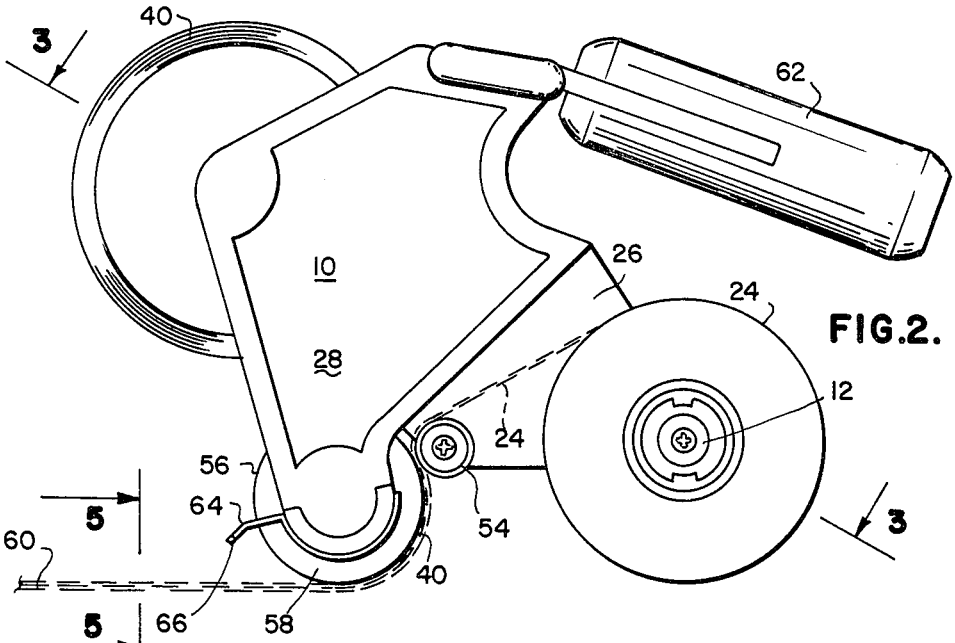
FIG.2.
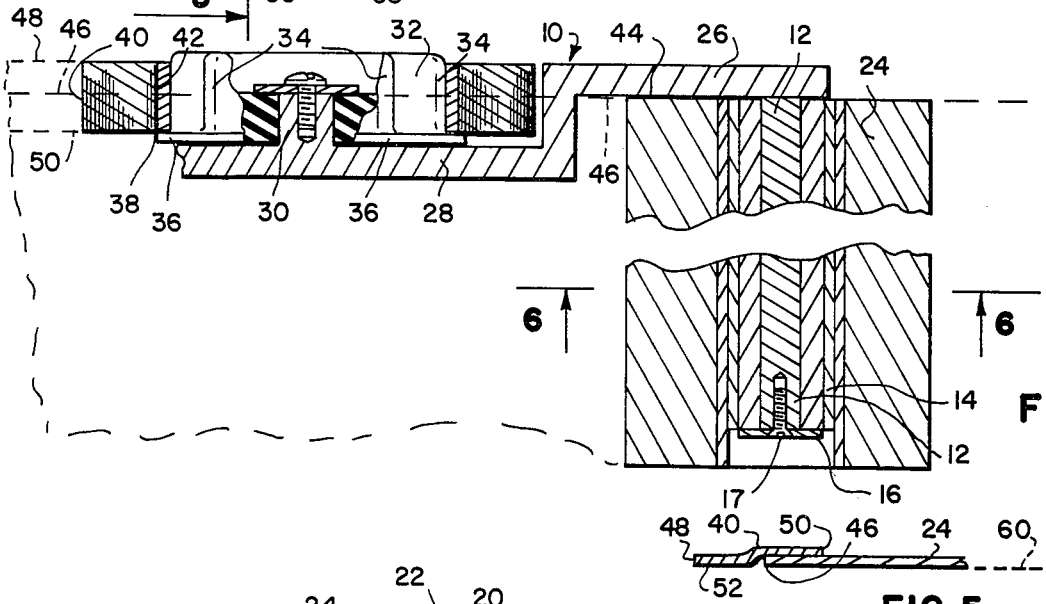
FIG.3.
FIG.5.
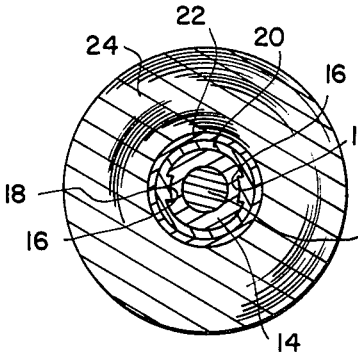
FIG.6.

HAND MASKING MACHINE

SUMMARY OF THE INVENTION

The present invention comprises a very simple and economical manually operable masking machine which is extremely convenient to operate and which is very light in weight and compact. The machine having a simple frame supporting a roll of masking paper having one edge in offset relationship to a roll of tape supported on the machine so that substantially half of the adhesive tape is overlapped with the edge of the paper and extends there beyond as to adhesively adhere to a surface for holding the paper in a masking position thereon. The machine having a novel idler roller and applicator roller so spaced as to compressively force the adhesive tape into contact with the paper immediately before it is passed over the applicator roller and onto a surface being masked. The machine also having a very novel cut off blade adjacent to the applicator roller so that the paper may be cut off neatly without tearing it loose from its masking position on a surface to which it has previously been applied. The machine also includes a novel means for keying a particular roll of paper to the spindle of the machine so that only such paper may be used on the machine and to thereby insure quality control as to the thickness and the stiffness of the paper in its relationship to the idler roller and applicator roller when the tape is being applied to the paper previous to the application of the paper and tape to a surface being masked.

The machine also provides for novel disposition of the handle of the machine relative to the tape holder roller and the paper holding spindle so that these elements stand clear of the surface being masked while the applicator roller is in a triangular relationship to the axis of the paper holding spindle and the tape holding roller thus insuring a compact machine which is very convenient to operate and which provides normal angle of the handle of the machine in such a direction that it is generally at right angles to the axis of the various aforementioned rollers and such as to hold the various rollers in triangulation so that only the applicator roller may be engaged with the surface being masked while the other rollers may be in close proximity thereto but in compact relation therewith all of which insures a light weight handy machine which may be used in a great variety of positions without fatigue to the operator and with the utmost convenience in masking all surfaces, even those in close quarters or corners.

Accordingly, it is an object of the invention to provide an approved light weight very convenient and simple hand masking machine which is economical to produce, efficient to use and which insures quality control of paper as well as the uniform dispensation of paper and tape from the machine which holds generally masking tape as well as paper in substantially equal lengths so that continuous masking may be without interrupting the supply of either the tape or the paper during masking operations.

Another object of the invention is to provide a machine which is very compact and provided with a handle in convenient disposition to the axis of the various rollers and the surface of a building room wall or other surface being masked.

Another object of the invention is to provide a novel combination of frame handle tape and paper supporting rollers as well as idler roller means together with applicator roller means and a paper cut off device all closely related to each other for efficiently applying masking paper to walls or other surfaces and for efficiently cutting it off at convenient locations without the usual problems of pulling the paper loose from the surface on which it has previously been applied.

Further objects and advantages of the invention may be apparent from the following specification, appended claims and accompanying drawings.

BRIEF DESCRIPTION OF THE DRAWINGS

FIG. 2 is an end view thereof taken from the line 2—2 of FIG. 1;

FIG. 3 is a fragmentary sectional view taken from the line 3—3 of FIG. 2;

FIG. 5 is a view taken from the line 5—5 of FIG. 2 showing the overlapped relationship of the adhesive tape dispensed by the machine relative to the edge of the paper dispensed by the machine; and FIG. 6 is a fragmentary sectional view taken from the line 6—6 of FIG. 3 showing a key means for keying a particular roll of paper to the paper roll supporting spindle on the frame of the machine.

DESCRIPTION OF THE PREFERRED EMBODIMENTS

Figure 1:
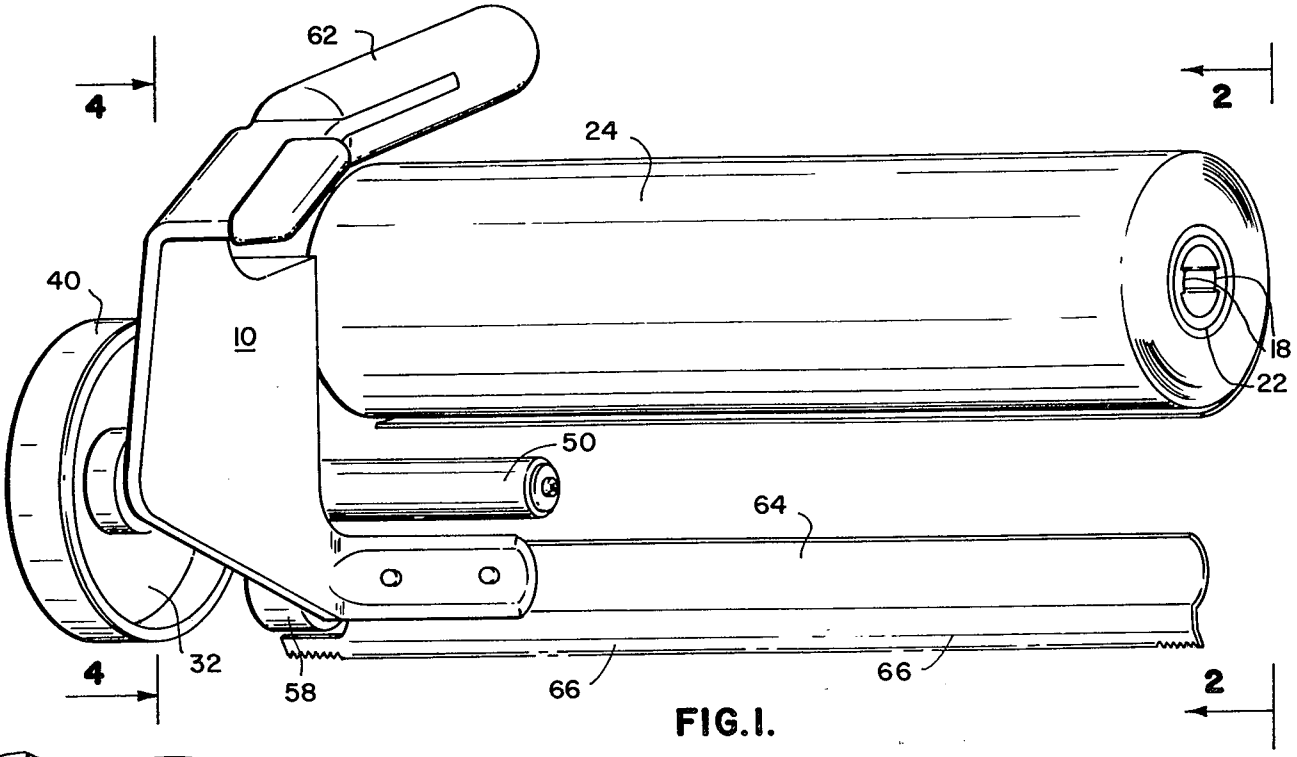
FIG. 1 is a perspective view of a manually operable masking machine in accordance with the present invention.
Figure 4:
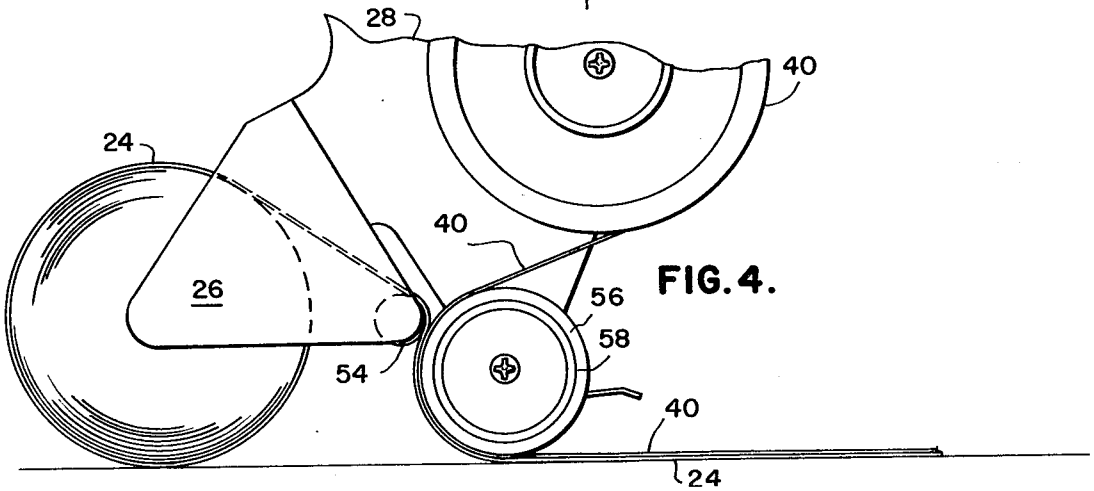
FIG. 4 is a fragmentary end view taken from the line 4—4 of FIG. 1.

As shown in FIG. 1, the machine is provided with a frame 10 shown best in FIGS. 1, 2, 3 and 4.

As shown best in FIGS. 1, 2, 3, the machine is provided with a paper roll spindle 12 having a rotating sleeve 14 rotatably mounted thereon, this sleeve 14 is retained by a washer 16 and a screw 18 which is threaded into the end of the spindle 12.

The sleeve 14 as shown in FIGS. 3 and 6 provided with a pleurality of external grooves 16 which receive internally directed ribs 18 of a key bushing 20 which is fixed to the inside of a paper roll supporting tube 22 on which a roll of paper 24 is peripherally wound.

It will be seen that according to the dimensions of the grooves 16 and the key portions 18 only a certain roll of paper may be placed upon the sleeve 14 to insure that the roll of paper 24 is of the proper quality and the proper thickness as well as stiffness for functioning in the machine of the invention as will be hereinafter described.

The spindle 12 as shown in FIG. 3 is mounted on an offset portion 26 of the frame 10 and another portion 28 of the frame 10 as shown in FIG. 3 is relatively offset and carries a bearing 30 which holds a rotary tape roll holder 32, this holder 32 is provided with a pleurality of radially disposed ribs 34 with stop tabs 36 adapted to engage the end 38 of a roll of adhesive tape designated 40. This roll of tape 40 has an internal bore 42 which is frictionally engaged with the ribs 34 and the overall length of the adhesive tape 40 is substantially the same as the length of paper in the paper roll 24. Thus concurrent dispensation of the paper and the tape may be done without running out of either commodity and such that both will run out at the same time.

As shown in FIG. 3, it will be seen that one end of the spindle 12 is disposed substantially at 44 and thus being capable of dispensing the roll of paper with an edge 46 thereof as indicated by broken lines in FIG. 3, such that the edge 46 is an intermediate position between opposite edges 48 and 50 as indicated by broken lines in FIG. 3 of the drawings, these edges being the opposite edges of the tape dispensed from the tape roll 40 and as shown in FIG. 5 the edge 46 of the paper 24 is disposed halfway between the opposite edges 48 and 50 of the tape from the roll 40. Thus an adhesive area 52 of the tape 40 is adapted to be engaged with a surface being masked such surface being a wall or ceiling of a building room if desired and the overlapping portion of the tape 40 is adhesively secured to the paper 24. This overlapping relationship is accomplished by passage of the paper 24 as shown in FIG. 2 over an idler roller 54 while the tape is dispensed from the tape roller 40 into contiguous relation with the paper 24 at the periphery of the idler roller 54 and the periphery 56 of an applicator roller 58 shown in FIGS. 1, 2 and 4 of the drawings.

The periphery of the idler roller 54 is very close to the periphery 56 of the applicator roller 58, the material of the applicator roller being compressible and such that it may run contiguous with the idler roller 54 previous to the placement of the paper 24 and the tape 40 concurrently between the idler roller 54 and the applicator roller 56 preliminary to dispensing and masking operations. The idler roller 54 is axially parallel to the spindle 12 and is axially parallel to the tape holder roller 32 as well as the axis of the applicator roller 58, all being axially parallel as shown in the drawings. Thus the machine is operated substantially in the position as shown in FIG. 2 wherein a surface designated 60 in FIG. 2 may be a wall or a ceiling and the periphery 58 of the applicator roller is used to press the paper and tape onto the surface such that the adhesive portion 52 shown in FIG. 5 is pressed and adhered to the surface 60 during rolling operation of the applicator roller while the handle 62 of the machine is in the position as shown in FIG. 2 and conveniently holding the periphery of the paper roller 24 and the roll of tape 40 clear of the surface 60. It being noted that the axis of the spindle 12, roll of tape 40 and the applicator roller 58 are in triangular disposition with each other such that the applicator roller 58 at its axis is opposite to the handle 62 and relative to a line passing through the axis of the spindle 12 and the roll of tape 40.

As shown in FIGS. 1 and 2, the axis of the handle 62 is also at right angles to the axis of the roll of paper 24 and the roll of tape 40 as well as the axis of the idler 50 and the applicator roller 58.

A cut off blade 64 is also generally axially parallel to the applicator roller 56 and extends there beyond as shown in FIGS. 1 and 2 of the drawings so that by rocking the handle 62 upward as shown in FIG. 2 a cutting edge 66 of the blade is brought to bear on the paper and it may be readily cut off without disturbing the adhered relationship of the tape 48 with the surface 60 hereinbefore described.

It will be seen that the machine of the invention is very compact with the handle 62 in close proximity to the working surface 60 and with the paper roller 24 and the roll of tape 40 in a position clear of the working surface to which the mask is being applied. The compact relationship of the idler roller 54 and the applicator roller 58 in relation to the roll of tape 40 and the roll of paper 24 provides a very convenient and light weight machine controlled by the handle 62 in the particular disposition as shown and hereinbefore described. The roll of paper 24 is keyed to the spindle 12 by means of the key structure 18 hereinbefore described to prevent unauthorized use of paper which will not properly function due to its structural characteristic and therefore operation of the machine is insured in that proper paper must be applied and cannot be mistaken due to the fact that improper rolls of paper may not be fitted to the spindle 12.

The common length of the tape and the paper provides a convenience such that the paper and tape will run out at the same time to avoid intermediate splicing operations which is very inconvenient during the masking of the surface 60. The angle of the handle together with the compact frame of the machine provides for convenience of use, lightweight reliability and economy, all of which has many advantages.

It will be obvious to those skilled in the art that various modifications may be resorted to without departing from the spirit of the invention.

We claim:

1. A manually operable masking machine having a frame provided with a manually holdable handle; a paper roll spindle rotatably mounted on said frame an adhesive tape roll holder rotatably mounted on said frame; said tape roll holder axially offset relative to the longitudinal axis of said paper roll spindle whereby a roll of tape on said holder is aligned with an end of said paper roll spindle so as to provide for the overlapping of an edge of paper aligned generally with said end of said spindle; means on said frame for holding said paper roll spindle such that an edge of a roll of paper thereon is directly aligned with an intermediate portion between opposite edges of tape carried by said tape roll holder; an applicator roller rotatably mounted on said frame and adapted to rotatably press tape and paper on a surface; and an idler roller having a periphery disposed in close proximity to said applicator roller so as to press said tape and said edge of said paper together as said paper and tape progresses between said applicator roller and said idler roller; the axially offset disposition of said roll of tape being such that substantially half of the width of said tape overlaps an edge of paper dispensed from said roll of paper so as to allow the remaining half of said tape to adhere to a surface beyond the edge of said paper when dispensed and rolled onto said surface.

2. The invention as defined in claim 1, wherein: there is a roll of tape on said holder; a roll of paper on said spindle; the length of said tape and said paper being substantially equal.

3. The invention as defined in claim 1, wherein: a paper cut off blade is coupled to said frame near said applicator roller; said blade being of a length to coincide with the width of paper on said roll.

4. The invention as defined in claim 1, wherein: said spindle is provided with an external key bushing; a roll of paper on said spindle having an internal key bushing adapted to mesh with said external key bushing on said spindle, whereby said roll of paper will custom fit only on said spindle of said machine to insure quality control of paper used on said machine.

5. A manually operable masking machine having a frame provided with a manually holdable handle; a paper roll spindle rotatably mounted on said frame; an adhesive tape roll holder rotatably mounted on said frame; said tape roll holder axially offset relative to the longitudinal axis of said paper roll spindle whereby a roll of tape on said holder is aligned with an end of said paper roll spindle so as to provide for the overlapping of an edge of paper aligned generally with said end of said spindle; means on said frame for holding said paper roll Spindle such that an edge of a roll of paper thereon is directly aligned with an intermediate portion between opposite edges of tape carried by said tape roll holder; an applicator roller rotatably mounted on said frame and adapted to rotatably press tape and paper on a surface; and an idler roller having a periphery disposed in closed proximity to said applicator roller so as to press said tape and said edge of said paper together as said paper and tape progresses between said applicator roller and said idler roller; and axially offset disposition of said roll of tape being such that substantially half of the width of said tape overlaps an edge of paper dispensed from said roll of paper so as to allow the remaining half of said tape to adhere to a surface beyond the edge of said paper when dispensed and rolled onto said surface; said handle is extended from said frame in a direction at substantially right angles to said spindle and also directed such that said applicator roller may be brought to bear on a surface; said spindle applicator roller and said tape holder being mounted on said frame generally in a triangular array relative to each other and all being generally axially parallel to each other; said handle being elongated and having a longitudinal axis generally parallel to a line which substantially intersects said spindle and said tape roll holder and whereby said trianbular disposition is such that said applicator roller is disposed at a position laterally relative to the axis of said handle and to and beyond said line passing through the axis of said tape holder roller and said spindle so as to permit said applicator roller to be engaged with a surface for applying paper and tape oppositely to and beyond the said line passing through the axis of said tape holder roller and said spindle to thereby allow clearance of said roll of paper relative to a surface on which paper and tape is being adhesively secured when said handle is used to move said machine for masking said surface.

* * * * *